US005879138A

United States Patent [19]

Arndt et al.

[11] Patent Number: 5,879,138

[45] Date of Patent: Mar. 9, 1999

[54] TWO-STAGE ROTARY VANE VACUUM PUMP

[75] Inventors: Lutz Arndt, Troisdorf; Peter Muller, Koln, both of Germany

[73] Assignee: Balzers Und Leybold Deutschland Holding AG, Germany

[21] Appl. No.: 586,926

[22] PCT Filed: Jul. 22, 1994

[86] PCT No.: PCT/EP94/02425

§ 371 Date: Jan. 29, 1996

§ 102(e) Date: Jan. 29, 1996

[87] PCT Pub. No.: WO95/04221

PCT Pub. Date: Feb. 9, 1995

[30] Foreign Application Priority Data

Jul. 28, 1993 [DE] Germany ..... 43 25 286.9

[51] Int. Cl.[6] ..... F04B 3/00

[52] U.S. Cl. ..... 417/244; 418/2; 418/13; 184/6.16

[58] Field of Search ..... 417/244; 418/2, 418/13, 88, 91; 184/6.16

[56] References Cited

U.S. PATENT DOCUMENTS

| | | | |
|---|---|---|---|
| 2,877,946 | 3/1959 | Garrison et al. | 418/2 |
| 2,902,210 | 9/1959 | Power | 418/13 |
| 5,178,522 | 1/1993 | Abelen et al. | 417/410 |
| 5,372,489 | 12/1994 | Matsuda et al. | 418/13 |

FOREIGN PATENT DOCUMENTS

| | | |
|---|---|---|
| 0459092 | 12/1991 | European Pat. Off. . |
| 0459112 | 12/1991 | European Pat. Off. . |
| 1948804 | 7/1970 | Germany . |
| 2354039 | 5/1975 | Germany . |
| 2401171 | 7/1975 | Germany . |
| 3805346 | 10/1988 | Germany . |

*Primary Examiner*—Charles G. Freay
*Attorney, Agent, or Firm*—Wall Marjama & Bilinski

[57] ABSTRACT

The invention pertains to a rotary vane vacuum pump (1) with a high vacuum stage (9, 22), with a fore-vacuum stage (8, 21), with a substantially cylindrical rotor (3) which has bearing and anchor segments (11 and 21, 22), a bearing segment (11) being situated between two anchor segments (21, 22) and the anchor segments (21, 22) having vane slots (25, 26), and with a roughly pot-shaped housing (2) which contains the pump chambers (8, 9) and whose base is designed as a bearing piece (13) with a passage (35) for the rotor drive. To provide for a simple manufacture, the invention proposes that the operational rotor (3) is of one piece, that both anchor sections (21, 22) of the rotor (3) are arranged on the face side, that the bearing segment (11) between the anchor segments (21, 22) is the only bearing segment and that both vane slots (25, 26) are open from their respective front sides. (Drawing FIG. 2)

21 Claims, 3 Drawing Sheets

TWO-STAGE ROTARY VANE VACUUM PUMP

BACKGROUND OF THE INVENTION

The invention pertains to a rotary vane vacuum pump with a high vacuum stage, with a fore-vacuum stage, with a substantially cylindrical rotor which has bearing and anchor segments, a bearing segment being situated between two anchor segments and the anchor segments having vane slots, and with a roughly pot-shaped housing which contains the pump chambers and whose base is designed as a bearing piece with a passage for the rotor drive.

High vacuum pumps require that the individual parts which effect the pumping of the gas be manufactured with the utmost precision. If, for example, in the case of a rotary vane vacuum pump, the slots between the vanes and the related vane slots in the rotor, the slots in the area of the anchor systems, or in the case of a two-stage rotary vane pump—the slots in the sealing area between the high vacuum stage and the fore-vacuum stage are too large, then flows occur which oppose the intended direction of flow (backstreaming) and which significantly impair the pumping characteristics, pumping speed, compression, ultimate pressure characteristic etc.

From FIG. 3 of DE-A-2354039 a two stage rotary vane vacuum pump of the aforementioned kind is known. Besides the bearing segment being situated between two anchor segments, the rotor has on one of its two face sides, (on the side of the fore-vacuum stage) a further bearing segment. Both vane slots must therefore be milled from the direction of the other face side—(the high vacuum side)—into the rotor. This has the disadvantage that a milling disc having a relatively large radius, greater than the sum of the lengths of the two vanes and the length of the bearing segment in the middle, must be employed. Moreover, after milling of the vane slots and for the purpose of manufacturing an operational rotor, a filling piece must be inserted again at the level of the middle bearing segment, so that a leak-tight mutual separation between the two stages of the vacuum pump is ensured. The manufacture of a rotor of this kind is involved. Milling of the vane slots is only possible with limited tolerances owing to the necessity of having to employ a milling disc of a relatively large diameter.

SUMMARY OF THE INVENTION

It is the task of the present invention to create a two-stage rotary vane vacuum pump of the aforementioned kind which can be produced in a simpler way and with greater precision.

This task is solved by the present invention according to the characteristic features of the patent claims. Because it is no longer necessary to provide a second bearing segment on one of the two face sides of the rotor, each vane slot may be milled into the rotor cylinder from its respective face side. The manufacture of a slot segment which must be filled again after it has been produced is no longer required. Milling discs having significantly smaller radii may be employed, and thus significantly smaller tolerances for the slot dimensions can be attained. Thus not only are the pumping properties improved; also assembly of the vane is simpler, since both slots are each accessible from their respective face side.

BRIEF DESCRIPTION OF THE DRAWINGS

Further advantages and details of the present invention shall be explained by referring to drawing FIGS. 1 to 5.

Drawing

Drawing

Drawing

Drawing

Drawing

Drawing

Figure 1:
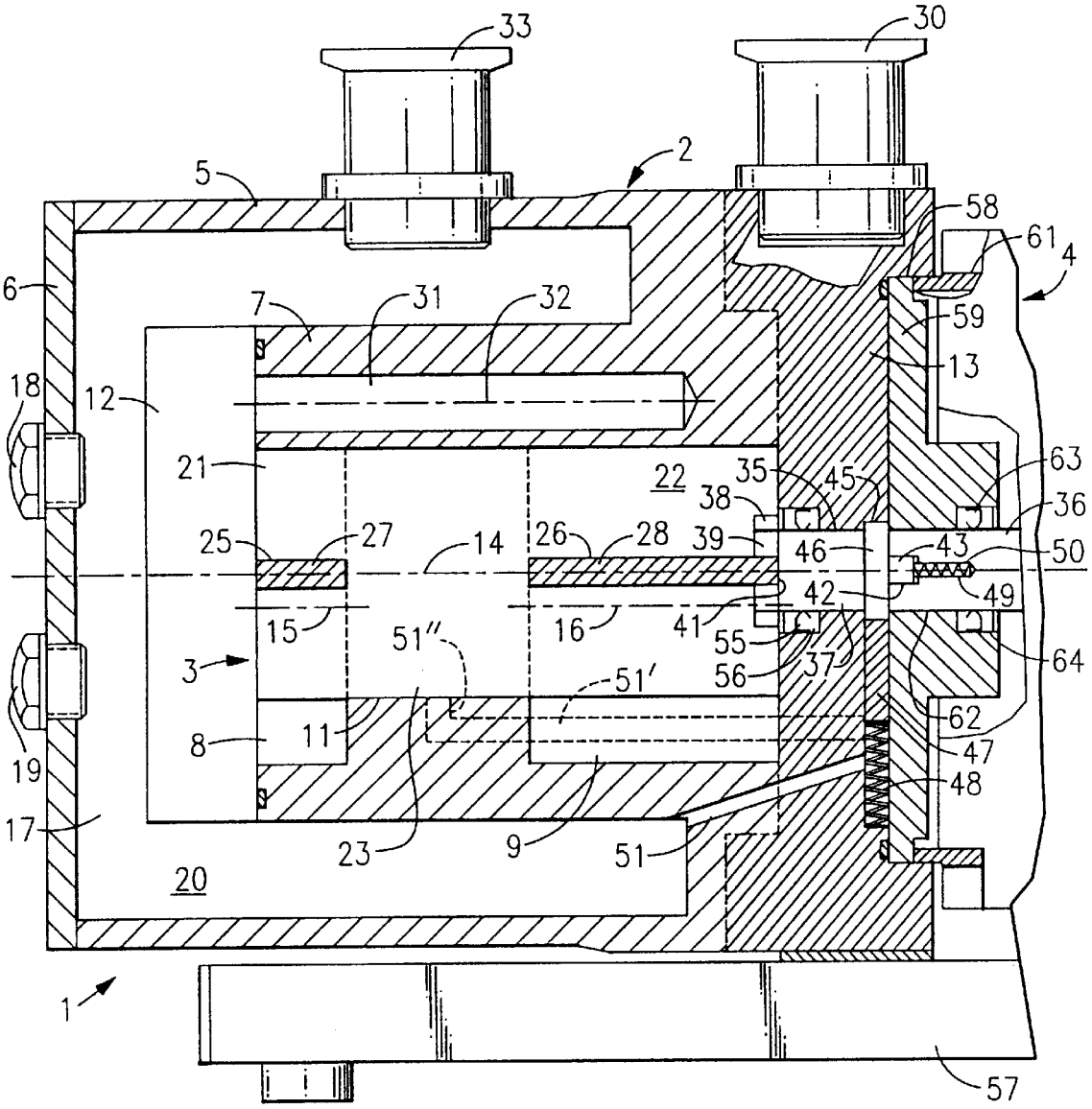
FIG. 1 shows a longitudinal section through a design example for a rotary vane pump according to the present invention.

The presented pump 1 comprises chiefly the subassemblies housing 2, rotor 3 and drive motor 4.

DESCRIPTION OF THE INVENTION

Housing 2 substantially has the shape of a pot with an outer wall 5, with the lid 6, with an inside section 7 containing pump chambers 8, 9 as well as bearing bore 11 with end piece 12 and bearing piece 13, which limit on their face sides the pump chambers 8, 9. The axis of the bearing bore 11 is designated as 14. Arranged eccentrically to this are the axes 15 and 16 of the pump chambers 8, 9. Oil space 17, which, during operation of the pump is partly filled with oil, is situated between outer wall 5 and the inside section 7. Two oil level glasses 18, 19 (maximum, minimum oil level) are provided in lid 6 for checking the oil level. Oil-fill and oil-drain ports are not shown.

Figure 3:
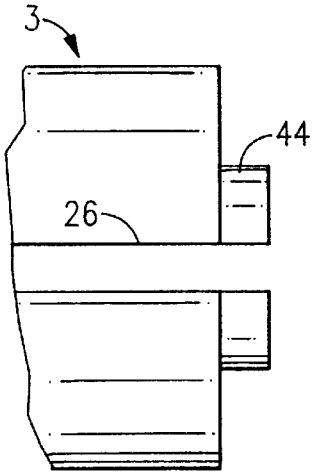
FIG. 3 shows the high vacuum face side of the rotor with projections.
Figure 2:
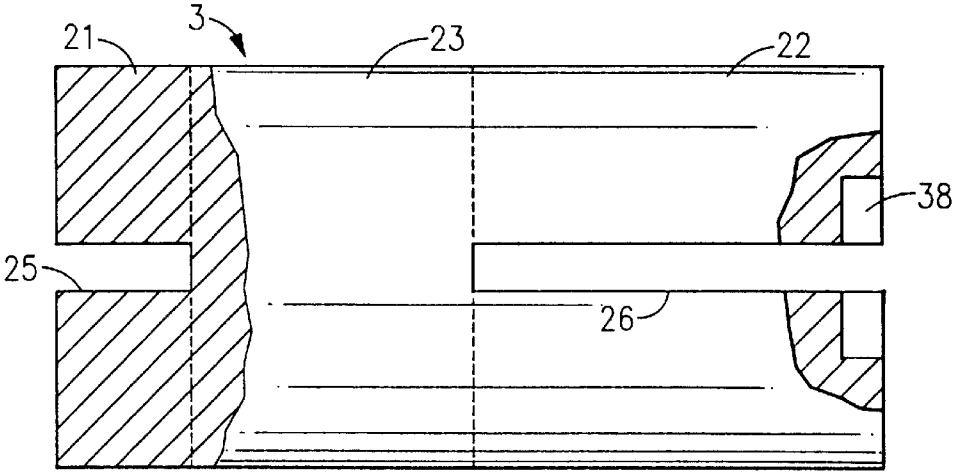
FIG. 2 shows a rotor according to the present invention.

Rotor 3, which is shown once more in drawing FIGS. 2 and 3, is situated within inside section 7. The rotor is made of one piece and has two anchor segments 21, 22 arranged on the face sides respectively, and a bearing segment 23 situated between the anchor segments 21, 22. Bearing segment 23 and anchor segments 21, 22 are of identical diameter. Anchor segments 21, 22 are equipped with slots 25, 26 for vanes 27, 28. These slots are milled from each of the respective face sides of the rotor so that precise slot dimensions can be easily attained. Bearing segment 23 is situated between anchor segments 21, 22. Bearing segment 23 and bearing bore 11 form the sole bearing of the rotor. This bearing must have a sufficient axial length so as to avoid a gyratory motion of the rotor. The length of the bearing is preferably selected so that in the case of a maximally angled orientation of rotor 3 owing to bearing play in bearing bore 11, the rotor 3 still remains afloat, i.e. it does not touch down simultaneously at both its face sides.

The anchor segment 22 and the corresponding pump chamber 9 are made longer than anchor segment 21 with pump chamber 8. Anchor segment 22 and pump chamber 9 form the high vacuum stage. During operation, the inlet of the high vacuum stage 9, 22 is linked to intake port 30. The discharge of the high vacuum stage 9, 22 and the inlet of the fore-vacuum stage 8, 21 are linked via bore 31 with its axis 32, which extends in parallel to axes 15, 16 of the pump chambers 8, 9. The discharge of the fore-vacuum stage 8, 21 leads to the oil space 17 which comprises oil sump 20. There the oil containing gases quiet down and leave the pump 1 through exhaust port 33. For reasons of clarity, the inlet and discharge openings of the two pump stages are not shown in drawing FIG. 1. The housing 2 of the pump is preferably also made of as few parts as possible. Preferably, the two pump chambers 8, 9 and the wall sections 5, 7 embracing the oil space 17 should be made of one piece.

The bearing piece 13 is equipped with a bore 35 for a rotor drive, said bore extending coaxially with respect to axis 14 of bearing bore 11. This rotor drive may be the shaft 36 of the drive motor 4. In the design example presented in drawing FIG. 1, a coupling piece 37 is provided between the unoccupied face side of drive shaft 4 and the rotor 3. The coupling of the rotor 3 to the coupling piece 37, as well as coupling of the coupling piece 37 to the drive shaft 36, is performed by way of a positive fit via projections and corresponding recesses. In the design example presented, the rotor 3 is equipped on its face side facing the coupling piece 37, with an elongated recess 38 which extends perpendicular to vane slot 26 (refer also to drawing FIG. 2). Coupling piece 37 engages via an elongated projection 39 into recess 38. The projection 39 of the coupling piece 37 is in turn equipped with a recess 41, which embraces vane 28. A corresponding link exists between the drive shaft 36 with its elongated recess 42 and the coupling piece 37 with the corresponding projection 43.

The recesses 38, 42, and the projections 39, 43 may also be interchanged. Shown in drawing FIG. 3 is a further solution, in which the face side of rotor 3 on the side of the drive is equipped with a projection 44 which is reduced in diameter. Thus a slot is created next to the space occupied by the vane into which an elongated projection on coupling piece 37 or on shaft 36 may engage.

In many, particularly larger two-stage vacuum pumps, the high vacuum stage 9, 22 has a higher pumping speed than the fore-vacuum stage. In order to achieve this for identical diameters of the anchor segments, the axial length of the high vacuum stage must be greater than the axial length of the fore-vacuum stage, at least twice as long, for example. By arranging the high vacuum stage on the side of the drive, the advantage results that only the short fore-vacuum stage is cantilevered, whereas the relatively long high vacuum stage is supported in the coupling piece 37, or if this is not present, in shaft 36.

Finally, the pump according to drawing FIG. 1 is also equipped with an oil pump. This consists of pump chamber 45 sunk into bearing piece 13 from the side of the motor with an eccentric 46 rotating within the pump chamber. A stopper 47 which is tensioned by spiral spring 48 rests against the eccentric 46.

The inlet of the oil pump 45, 46 is linked to the-oil sump 20 via a bore 51. All parts of the pump 1 which require oil are linked to the discharge of the oil pump 45, 46. Presented as an example is a bore 51' which leads via a crossing bore 51" in the bearing segment 23 into the inside section 7 of the pump 1 and which supplies the bearing situated there with lubricating oil.

In the design example according to drawing FIG. 1, the eccentric 46 of the oil pump is part of the coupling piece 37. It is either fixed or attached by means of a positive fit, arranged axially movable on projection 42, to the coupling piece 37. In all, the solution which has been described, offers the possibility of being able to dispense with a separate bearing for the motor shaft 36 on the pump side. The bearing piece 13 and, if present, the coupling piece. 37 may take over this function. Moreover, there exists the possibility to generate, in the area of the face side shown in FIG. 1 of shaft 36, setting forces for the bearing (not shown) present in the area of the other shown face side (not shown) of shaft 36. For this, the face side shown is provided with a central pocket hole 49 in which pressure spring 50 is situated. Pressure spring 50 is supported by the projection 43 of the coupling piece 37 as well as by the pocket hole 49 and generates forces which oppose each other on shaft 36 (setting forces for the bearing of shaft 36 not shown) and the coupling piece 37. Particularly, in the case of an axially movable eccentric 46, these forces also act upon rotor 3, the fore-vacuum face side of which is thus forced against the end piece 12. This force reduces the slot existing between the face side of the rotor and the end piece 12 which occurs owing to play, so that a substantial improvement of the compression capacity and thus an improved ultimate pressure can be attained. This tightness advantage in the area of the fore-vacuum stage results independently of the existing tolerances and can thus be attained without specially increasing the complexity of the manufacturing process.

Coupling piece 37 also forms the running surface for a sealing ring 55 which is situated in a ring-shaped recess 56 in the bearing piece 13, specifically on the side of bearing piece 13 facing the pump chamber 9. If rotor 3 is directly coupled to the drive shaft 36, then bearing piece 13 may be equipped with a further recess on the side of the motor for a sealing ring. Finally, bearing piece 13 has the function of supporting pump 1 via the base 57 screwed to bearing piece 13.

In the design example with the oil pump 45, 46 which is presented, the bearing piece 13 is equipped on its side facing motor 4, with a circular recess 58 in which a piece 59 is located. This piece is maintained in its position by the housing 61 of drive motor 4. It is equipped with a central bore 62 through which shaft 36 of the drive motor 4 passes. The shaft 36 forms the running surface for a second shaft sealing ring 63 which is situated in a recess 64 on the side of the motor in piece 59. Moreover, it is the task of piece 59 to limit the pump chamber 45 of the oil pump 45, 46. Finally piece 59 may, on its own or in conjunction with bearing piece 13, also form the only bearing on the pump side of motor shaft 36.

Figure 4:
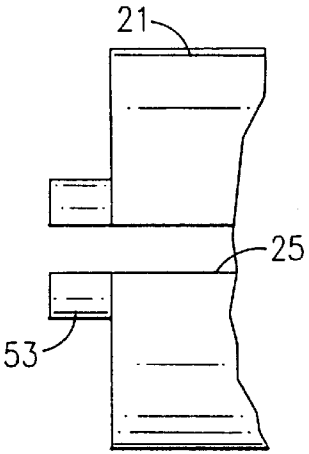
FIG. 4 shows the fore-vacuum face side of the rotor with projections.
Figure 5:
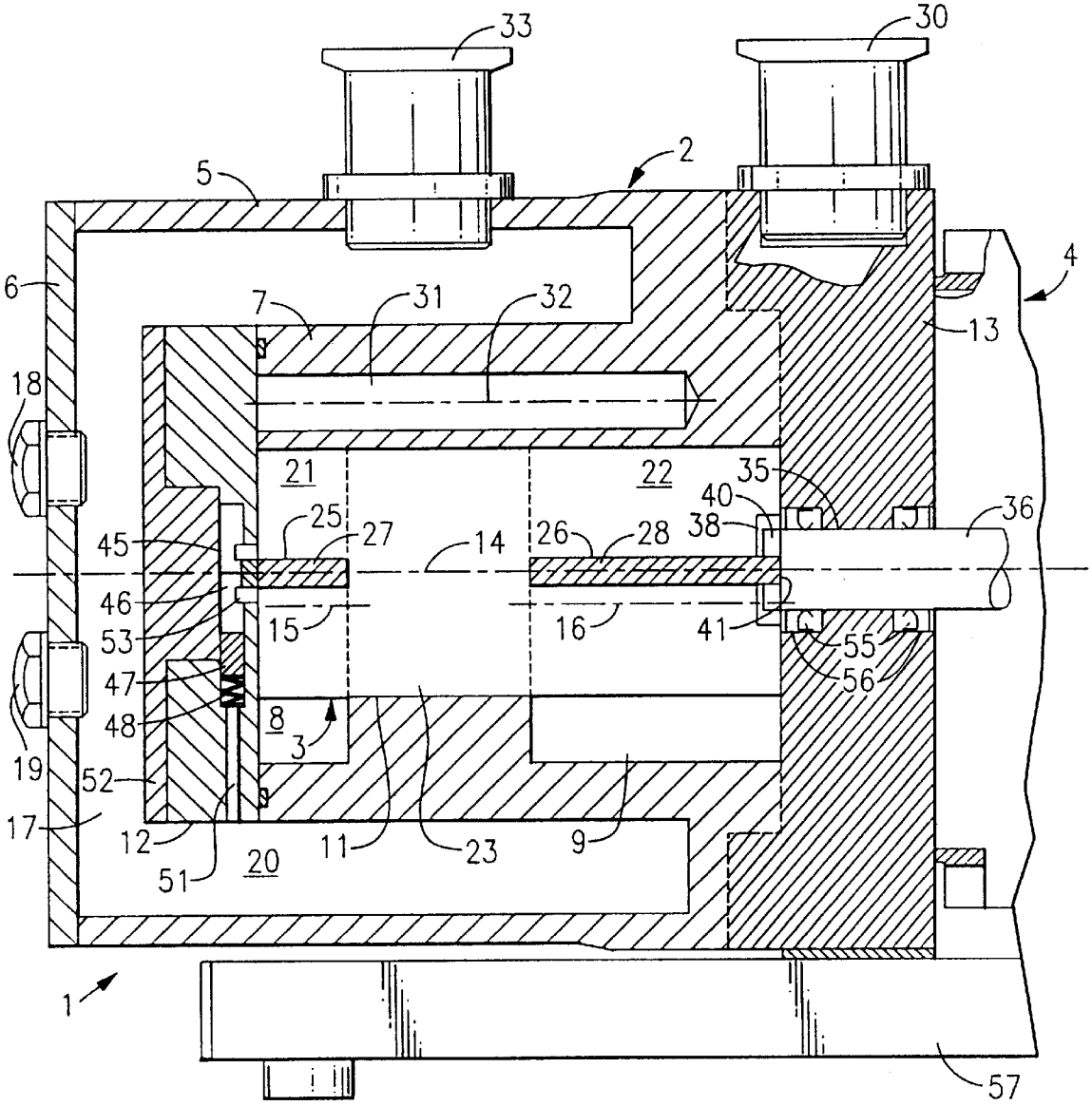
FIG. 5 shows a longitudinal section through a further design example for a pump according to the present invention.

In the design example according to drawing FIG. 5, the shaft 36 of the drive motor 4 is directly linked to rotor 3. Located in the bearing piece 13 are two recesses 56 with gaskets 55, since the lid piece 59 can be omitted. A cam 49 arranged on the side of the shaft engages in the recess 38 of rotor 3. The oil pump 45, 46 is situated in the end piece 12 on the fore-vacuum side, which, for the purpose of housing pump chamber 45 of the oil pump, is equipped with a lid 52. The eccentric 46 of the oil pump is driven by projections or cams 53 at the face side of rotor 3 on the fore-vacuum side (refer also to drawing FIG. 4). The oil pump 45, 46 is linked to oil sump 20 via bore 51. Channels which supply oil to points within pump 1 and which are connected to the discharge of oil pump 45, 46 are not shown.

Figure 6:
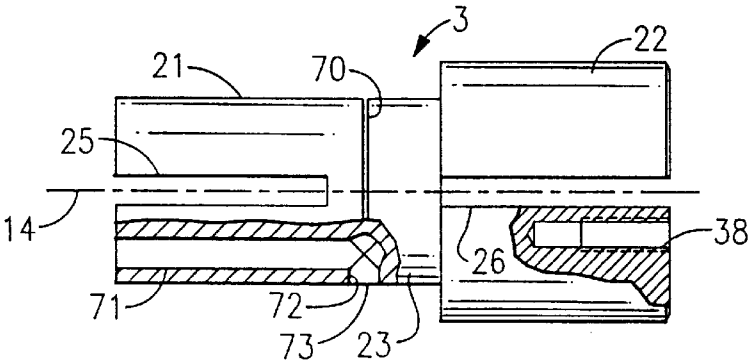
FIG. 6 shows a further design example for a rotor according to the present invention.

Shown in drawing FIG. 6 is a further design example for rotor 3. Bearing segment 23 and anchor segment 21 of the fore-vacuum stage 8, 21 have a smaller diameter compared to anchor segment 22 of the high vacuum stage 9, 22 in order to keep the frictional forces low in these areas. In a pump (not shown) where a rotor 3 of this kind is employed, the diameters of the pump chamber 8 and the bearing bore 11 must also be reduced.

Further differences between the rotor 3 according to drawing FIG. 6 and the rotor 3 according to drawing FIG. 2 are:

- The recesses 38 in the unoccupied face side of anchor segment 22 of the high vacuum stage 9, 22 have the shape of pocket holes. Correspondingly the projections 39 at coupling piece 37 must be pin-shaped (not shown).
- The bearing segment 23 is equipped with a circular groove 70 which is situated approximately at the level of the leadout of cross bore 11 (c.f. drawing FIG. 1). An adequate supply of lubricant to the bearing is thus ensured.

The anchor segment 21 of the fore-vacuum stage is equipped with an long bore 71 which begins on its face side and which is linked to a cross bore 72. The readout 73 of cross bore 72 is situated at the level of the groove 70 and thus also in the area of the leadout of cross bore 51" on the side of the housing. The slot between the face side of anchor segment 21 and the bearing lid 12 is lubricated via bores 71, 72.

The design examples which are presented, are based on a minimum number of individual parts. This is achieved by components taking over several functions. Thus the pump according to the present invention is easier to manufacture and thus more cost-effective.

What is claimed is:

1. A rotary vane vacuum pump having a high-vacuum stage and a fore-vacuum stage, said pump comprising a substantially cylindrical operational rotor including a bearing segment and a pair of anchor segments, the bearing segment being situated between the pair of anchor segments in which each anchor segment includes a vane slot, and a roughly pot-shaped housing which contains two pump chambers and a base designed as a bearing piece with a passage therein for a drive of the rotor, wherein the operational rotor is made of one piece with one of said anchor segments being arranged in the fore-vacuum stage and the other of said anchor segments being arranged in the high-vacuum stage, respectively, wherein the bearing segment between the pair of anchor segments is the only bearing segment and in which each of said vane slots are open from respective face sides of each anchor segment, each said face side being arranged away from said bearing segment.

2. A pump according to claim 1, wherein the high-vacuum stage is situated directly next to the bearing piece and the face side of the anchor segment of the high-vacuum stage is equipped with fitting means for fitting the rotor to a drive shaft of a motor.

3. A pump according to claim 2, wherein the fitting means includes a recess for accepting a projection.

4. A pump according to claim 3, wherein the recess has an elongated shape extending across and approximately perpendicular to the vane slot of the anchor segment of the high-vacuum stage and the projection, which in its size corresponds to the recess of said fitting means, includes a recess for embracing a vane.

5. A pump according to claim 1, wherein a wall section of the housing which is common to both pump chambers is made from one piece.

6. A pump according to claim 1, wherein said base supports the pump.

7. A pump according to claim 1, further comprising an oil pump and a channel linked to a discharge of the oil pump, the channel leading substantially to the bearing segment.

8. A pump according to claim 7, further comprising a coupling piece situated in the passage of the bearing piece, said coupling piece providing a positive fit for the rotor and a drive shaft of said motor, said coupling piece further providing a running surface for at least one rotary drive shaft seal and a carrier for a rotor of the oil pump.

9. A pump according to claim 7, wherein the oil pump is located in an end piece on a side opposite to the drive shaft of said motor.

10. A pump according to claim 9, wherein the drive shaft of said motor and one face side of the rotor, as well as a rotor of the oil pump and the other face side of the rotor are linked by fitting means.

11. A pump according the claim 8, wherein the passage in the bearing piece and a passage in a lid form a single support for the motor shaft on a pumping side.

12. A pump according to claim 2, wherein a spring is arranged between the rotor and the drive shaft of said motor, said spring exerting axially directed forces onto the rotor and the shaft.

13. A pump according to claim 12, wherein the spring is situated between a coupling piece and the drive shaft.

14. A pump according to claim 13, wherein the spring is supported by a projection of the coupling piece and a pocket hole in a face of the drive shaft.

15. A pump according to claim 1, wherein the bearing segment is equipped with a circular groove.

16. A pump according to claim 15, wherein the rotor is equipped with first and second bores, the first bore opening on the fore-vacuum side of the rotor and the second bore opening on a radial side the bearing segment.

17. A pump according to claim 16, wherein the circular groove and a leadout of the second bore are situated in the bearing segment at a level of a leadout of a bore on a side of the housing.

18. A pump according to claim 1, wherein the bearing segment and the anchor segments have the same diameter.

19. A pump according to claim 18, wherein the bearing piece and the housing are made from one piece.

20. A pump according to claim 18, wherein the anchor segment of the high-vacuum stage is at least twice as long as the anchor segment of the fore-vacuum stage.

21. A pump according to claim 1, wherein the length of the bearing segment is sized such that in the case of a maximally angled orientation of the rotor, owing to bearing play in a bearing bore, the rotor does not touch down simultaneously at face sides thereof.

* * * * *